United States Patent [19]

Knowles

[11] 4,346,679

[45] Aug. 31, 1982

[54] STARTING AIDS FOR INTERNAL COMBUSTION ENGINES

[75] Inventor: Richard P. Knowles, Farnborough, England

[73] Assignee: Lucas Industries Limited, Birmingham, England

[21] Appl. No.: 110,629

[22] Filed: Jan. 9, 1980

[30] Foreign Application Priority Data

Feb. 1, 1979 [GB] United Kingdom ..... 7903601

[51] Int. Cl.[3] ..... F02M 31/00

[52] U.S. Cl. ..... 123/145 A; 123/253; 123/254; 219/523

[58] Field of Search ..... 123/145 A, 179 H, 253, 123/254, 260; 338/229, 230, 32, 32.1, 32.2, 32.3, 32.31; 219/205, 206, 207, 270, 267, 523, 260, 540, 544, 530; 361/264, 266, 265

[56] References Cited

U.S. PATENT DOCUMENTS

| | | | |
|---|---|---|---|
| 2,918,561 | 12/1959 | Perez | 219/523 |
| 3,140,697 | 7/1964 | Peras | 123/254 |
| 3,251,017 | 5/1966 | Okerstrom | 338/229 |
| 3,407,794 | 10/1968 | Nagai | 123/145 A |
| 3,937,923 | 2/1976 | Smith | 219/523 |

FOREIGN PATENT DOCUMENTS

| | | | |
|---|---|---|---|
| 230210 | 6/1959 | Australia | 123/145 A |
| 235779 | 11/1959 | Australia | 123/145 A |
| 2755968 | 7/1978 | Fed. Rep. of Germany | 123/145 A |
| 861842 | 3/1961 | United Kingdom | 123/145 A |

*Primary Examiner*—Ronald H. Lazarus

[57] ABSTRACT

A starting aid for an internal combustion engine comprises a tubular extension in the end of which is a spirally wound electric heating element. The extension is secured to a body which in use is located in a bore in the cylinder head of the engine so that at least part of the extension extends into a combustion chamber of the engine. The extension mounts a sleeve extending from the body towards the end of the extension and this is formed from a material having a high thermal conductivity. The sleeve acts to minimize the temperature attained by the extension when the aid is in use.

5 Claims, 4 Drawing Figures

STARTING AIDS FOR INTERNAL COMBUSTION ENGINES

This invention relates to starting aids for internal combustion engines of the kind comprising a body adapted to be retained in a bore formed in the cylinder head of the engine, a tubular extension located at one end of the body, part of said extension in use extending within a combustion chamber of the engine and a wound heating element located within the end of the tubular extension, said element in use, being heated by the passage of electric current to provide a heated surface within the combustion chamber.

An aid of this type is described in the specification of British Pat. No. 1,127,454. As described the heating element is formed from a metallic tape which is spirally wound about a central conductor rod to which the inner end of the element is connected. The outer end of the element is connected to the wall of the extension. The element is retained in position within the end of the extension by a glass sleeve which is located about the conductor rod and has its outer end adjacent the heating element.

It has been found that the service life of such a starting aid is considerably shortened in certain types of engines where the conditions within the combustion chamber are particularly severe. The portion of the extension located in the combustion chamber is subjected to the hot gases produced by combustion of fuel within the combustion chamber and a considerable amount of heat is absorbed by the extension to the point where mechanical failure of the aid occurs not necessarily whilst the heating element is being supplied with electric current.

It has been found that the service life of the aid can be extended if in use, the temperature of the extension is reduced. If however, the thermal inertia of the heating element is materially increased then it will take longer to achieve its working temperature.

The object of the invention is to provide a starting aid of the kind specified in a simple and convenient form.

According to the invention a starting aid of the kind specified comprises a sleeve mounted about said extension, said sleeve being in heat exchange relationship with the surface of the portion of the extension about which it is located, said sleeve extending from the end of the extension adjacent the body to a position spaced from the end of the extension, the sleeve being formed from a material having a high thermal conductivity.

According to a further feature of the invention the end of the sleeve adjacent the body is extended to define a flanged portion which in use, is trapped between the body and a step defined in the wall of the bore in which the aid is located.

Figure 1:
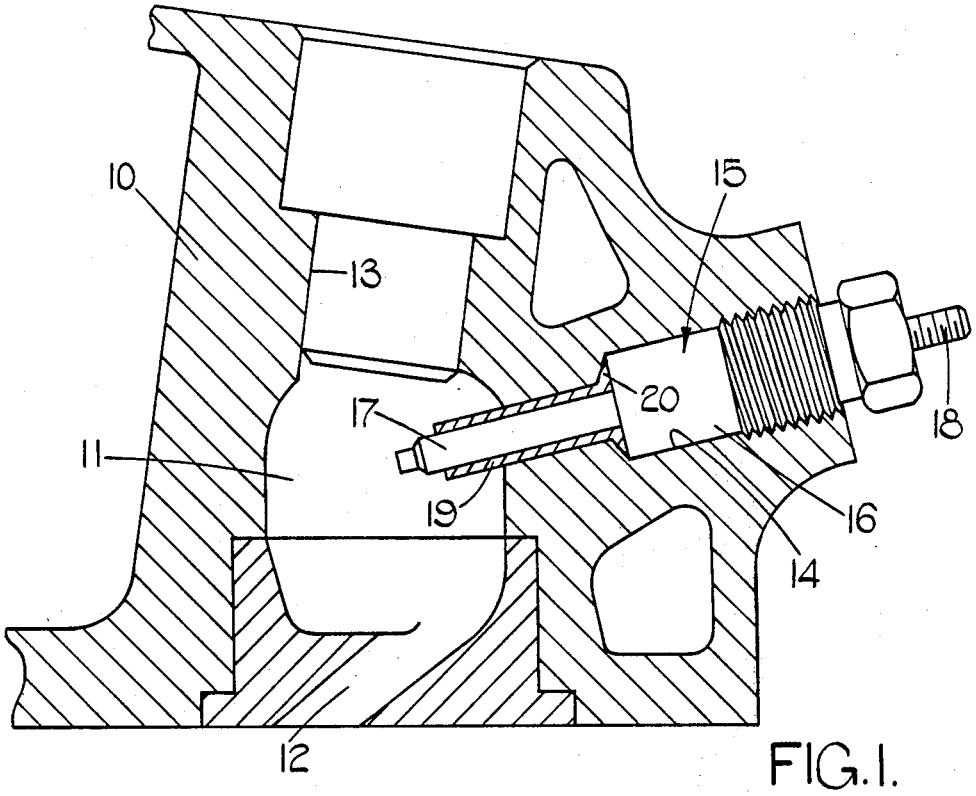
Figure 2:
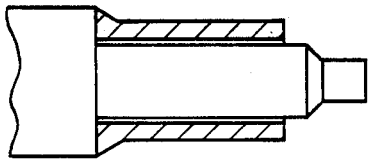
Figure 3:
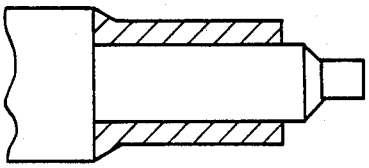
Figure 4:
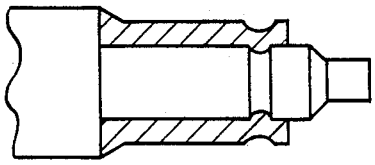

In the accompanying drawings:

FIG. 1 is a sectional elevation through the cylinder head of a compression ignition engine showing a starting aid mounted on the engine, and, FIGS. 2, 3 and 4 show part sectional side elevations of parts of starting aids in accordance with the invention.

Referring to FIG. 1 of the drawings, a cylinder head 10 of an engine defines a pre-combustion chamber 11 which communicates with the associated cylinder by way of a passage 12. The cylinder head is provided with a pair of bores 13, 14 each of which is of stepped form. The bore 13 in use, accommodates a fuel injection nozzle through which liquid fuel is supplied under pressure to the precombustion chamber 11.

The bore 14 locates a starting aid 15 which comprises a body portion 16 having screw threads for engagement with complementary threads formed in the wider portion of the bore 14. The body of the starting aid extends beyond the end of the bore 14 and is of hexagonal form to facilitate the tightening of the aid within the bore.

Extending through the narrower portion of the bore 14 into the combustion space is a cylindrical extension 17 which at its end within the combustion chamber has an end portion of reduced diameter formed by a reduced wall thickness. The extension is of tubular form and located within the end portion is a spirally wound electric heating element formed from a metal tape. The outer end of the tape is secured to the extension 17 whilst the inner end is secured to a support rod extending within the extension and connected with a terminal 18 which in use is connected to a source of electric supply through a switch. The other terminal of the source of supply is connected to the engine and the arrangement is such that when the switch is closed the aforesaid heating element will heat quickly to its operating temperature to facilitate the starting of the engine. The rapid heating is obtained because the thermal inertia of the heating element is low.

In use during the compression stroke of the associated engine, air is forced into the pre-combustion chamber 11 through the passage 12. The temperature of the air within the combustion chamber rises as compression of the air takes place and fuel sprayed into the combustion chamber is ignited under normal circumstances, by the fact that the temperature within the combustion chamber is sufficient to cause ignition. The combustion gases escape through the passage 12 to act upon the piston within the cylinder. For starting purposes the heating element is supplied with electric current and the hot surface of the element assists the initiation of combustion since when the engine is cold, the temperature of the compressed air within the combustion chamber at the end of the compression stroke may be insufficient to promote rapid ignition of the injected fuel.

The end portion of the extension 17 within the combustion chamber is subjected to considerable heat from the burning gases and in addition the main portion of the extension due to the turbulence of the gases, is also subject to considerable vibration. Its wall thickness is therefore chosen to withstand the stress in the region adjacent the body 16. The end portion is of reduced wall thickness to reduce the thermal inertia of the heating element.

It has been discovered that if the temperature of the extension is reduced, the service life of the aid is considerably extended. The problem however, is that if the thermal inertia of the heating element is materially increased, then it will take longer to achieve its operating temperature.

In order to reduce the temperature attained by the extension, a sleeve 19 is located about the extension and extends from the body 16 to a position spaced from the reduced end portion in which the heating element is located. The sleeve is formed from a material having a high thermal conductivity and an example of such a material is copper. Moreover, the internal surface of the sleeve 19 is maintained in heat exchange relationship with the surface of the extension and as shown in FIG. 2, the sleeve may be bonded to the extension or as shown in FIG. 3, it may be an interference fit over the extension. In the arrangement shown in FIG. 4 the sleeve is spun into a groove formed in the extension. The sleeve acts to convey heat away from the extension but it does not extend to the end of the extension, and therefore has little effect on the time taken for the heating element to achieve its working temperature. It has been found that there is a significant reduction in the temperature attained by the end portion of the extension and in particular by the heating element and the glass sleeve within the extension.

It will be noted that the sleeve 19 at its end adjacent the body 16 defines a flange 20 which is trapped between the body and the step defined between the two parts of the bore 14. Conveniently, the presented surfaces of the step and the sleeve are inclined relative to the axis of the bore, it being understood that a seal is established therebetween to prevent gases escaping from the combustion chamber.

The amount by which the sleeve 19 extends towards the end of the extension depends on how much temperature reduction is required. At the same time, it must be remembered that if the thermal inertia of the heating element is materially increased, then the amount of time required for the heating element to attain its working temperature will also be increased.

The provision of the sleeve 19 does stiffen the extension and it makes it less susceptible to vibration which may be induced by the turbulence of the gases within the combustion chamber or mechanical vibration induced by engine vibration.

I claim:

1. A starting aid for an internal combustion engine comprising a body, a tubular extension located at one end of the body, said extension having a diameter of a size such that a shoulder is formed between the body and the extension, a wound heating element located within the end of the tubular extension, said heating element in use, being heated by the passage of electric current to provide a heated surface, a sleeve mounted about said extension, said sleeve being in heat exchange relationship with the surface of the portion of the extension about which it is located, the sleeve extending from said shoulder to a position spaced from the end of the extension, the sleeve being formed from a material having a high thermal conductivity.

2. A starting aid according to claim 1 in which said sleeve is an interference fit on the extension.

3. A starting aid according to claim 1 in which said sleeve is bonded to said extension.

4. A starting aid according to claim 1 in which the extension is provided with a groove and the sleeve has a portion deformed into said groove.

5. A starting aid according to claim 1 in which the end of the sleeve adjacent the body defines a flanged portion.

* * * * *